US006668881B2

(12) United States Patent
Annaka

(10) Patent No.: US 6,668,881 B2
(45) Date of Patent: Dec. 30, 2003

(54) METHOD FOR FORMING A CURVED SURFACE IN A CURVED DECORATED BOARD

(75) Inventor: Shigeru Annaka, Muramatsu-machi (JP)

(73) Assignee: Annaka Factory Co, Ltd. (JP)

( * ) Notice: Subject to any disclaimer, the term of this patent is extended or adjusted under 35 U.S.C. 154(b) by 100 days.

(21) Appl. No.: 10/042,067

(22) Filed: Oct. 19, 2001

(65) Prior Publication Data

US 2002/0157732 A1 Oct. 31, 2002

(30) Foreign Application Priority Data

Apr. 27, 2001 (JP) ..... 2001-133217

(51) Int. Cl.[7] ..... B27G 11/00
(52) U.S. Cl. ..... 144/349
(58) Field of Search ..... 144/349, 346, 144/345, 381, 352; 156/221, 268

(56) References Cited

U.S. PATENT DOCUMENTS 1,154,806 A * 9/1915 Redmon ..... 144/349
4,089,721 A * 5/1978 Sauder ..... 156/212
4,342,349 A * 8/1982 Lipman ..... 144/371
4,495,019 A * 1/1985 Ogg ..... 156/222
4,952,462 A * 8/1990 Bright ..... 428/542.2
5,060,705 A * 10/1991 Woodward et al. ..... 144/350
6,210,512 B1 * 4/2001 Jones ..... 156/220

FOREIGN PATENT DOCUMENTS

| | | | |
|---|---|---|---|
| JP | 47-13911 Y1 | | 5/1972 |
| JP | 54114588 | * | 9/1979 |
| JP | 55-90414 | | 6/1980 |
| JP | 56-3607 | | 1/1981 |
| JP | 63-35413 B2 | | 7/1988 |
| JP | 02270502 | * | 5/2002 |

* cited by examiner

*Primary Examiner*—Allen Ostrager
*Assistant Examiner*—Shelley Self
(74) *Attorney, Agent, or Firm*—Akerman Senterfitt

(57) ABSTRACT

A method for forming a curved surface in a decorated board which enables a woodworking process to be easily performed on a peripheral edge of a curved decorated board. A base board 1 and a decorating material 2, which eventually construct a headboard A as a decorated board, are each prepared by cutting a woody material into a preset configuration. After that, they are painted. With the base board 1 and the decorating material 2 remaining flat, the respective peripheral edges thereof are formed with chamfered portions 3, 4 through a woodworking process. Thus, such wood working can be performed without complex control. The base board 1 and the decorating material 2 thus worked are integrally laminated to each other, and then the headboard A thus obtained is bent, using a press machine or the like.

9 Claims, 16 Drawing Sheets

(a)

(b)

METHOD FOR FORMING A CURVED SURFACE IN A CURVED DECORATED BOARD

BACKGROUND OF THE INVENTION

1. Field of the Invention

The present invention relates to a method for forming a curved surface in a decorated board which is used as an ornamental panel for furniture such as a headboard of a bed, a backrest or an armrest of a chair, as well as an architectural product such as a door panel or a partition plate between rooms.

2. Description of the Related Art

Conventionally, a variety of furniture products have been easily formed to have a curved surface, using a mold in the event that they are made of synthetic resin or metal. For woody furniture products, however, they are produced by working flat plate materials in general, and thus if a curved surface is employed as a part of design for a certain furniture product, then a flat plate material which was cut to a predetermined size beforehand must be bent, using a pressing machine or the like.

For a headboard for bed, for example, a peripheral edge of a material sometimes undergoes a woodworking process so as to chamfer the corners thereof, and/or the surface of a headboard might be formed with a decorative irregular pattern to enhance the attractiveness of design. These woodworking or decorative patterning to the surface of a headboard has heretofore been carried out by a machining device, and painting has been applied to headboards thus worked or decorated to a final product.

However, when a headboard is designed to eventually define a curved surface as a whole, and that in the event that a planar wood material is first bent and then a peripheral edge thereof undergoes woodworking or surface decorating, then it would be necessary to control a machining device and/or a painting nozzle three-dimensionally, to adjust to the curvature of the bent wooden material. Particularly for woodworking of the peripheral edge of a wooden material, a woodworking device must be operated along the outline thereof, and be controlled to comply with the curvature of the plate material. If these steps are automated, using a machining device, then extremely complicated control must be performed, which is only possible by using an extremely expensive five-axis control device.

Therefore, in a case where woody furniture products such as headboards employ a curve design, most of them have heretofore been produced by simply bending a flat board, without going through any woodworking process. In other words, as wood-based materials include moisture contents that vary widely in general, and are stored in varying conditions, and that temperature and moisture at the time of woodworking are hardly kept constant, it has been very difficult to keep a bending angle constant. Besides, post-bending process is extremely difficult due to the occurrence of backlash. Although simple rounding work which permits roughness to some extent is possible, precise working with precise accuracy is very difficult.

SUMMARY OF THE INVENTION

The present invention address the above-mentioned problems, with the object of providing a method for forming a curved surface in a decorated board which enables a variety of finish processing to be performed on a decorated board without using an expensive five-axis control device, while enhancing a degree of freedom in design.

To attain the above objects, there is provided, according to a first aspect of the invention, a method for forming a curved surface in a decorated board formed by laminating a flat decorating material to a flat woody base board, which comprises the steps of: working at least one of the said base board and the decorating material; laminating said decorating material to said base board to integrally form a decorated board; and subjecting said decorated board to a bending process to define a curved surface.

With the construction of the first aspect, a woodworking process is performed with the base board and/or the decorating material remaining flat, which undergo a painting process where necessary, and then they are subjected to a bending process. Accordingly, when subjecting the peripheral edges of the base board and the decorating material to the woodworking process, using a machining device, it suffices to control the device so that it may run along the peripheral edge of the flat base board and decorating material, and thus, no complicated five-axis control is necessary, thereby leading to an enhanced production processability. The base board and decorating material thus curved have their peripheral edges formed with decorating patterns or outlines, as a result of the woodworking.

According to a second aspect of the present invention, there is provided a method for forming a curved surface in a decorated board as set forth in the first aspect, wherein a positioning means for positioning said base board and said decorating material is provided when they are laminated to each other.

Accordingly, when bending the decorated board after integrally laminating the decorating material to the base board, the decorating material can be precisely fixed to the base board, without causing misalignment or displacement therebetween.

According to a further aspect of the present invention, there is provided a method for forming a curved surface in a decorated board formed by laminating two flat base boards, which comprises the steps of: forming a step groove in at least an inner edge of each base board; laminating these two base boards each other to integrally form a decorated board; subjecting the decorated board to a bending process; covering the bent decorated board with a cloth, while accommodating a margin of the cloth into a concave groove formed by said step groove of each base board.

In the case of covering the decorated board with a cloth, two cloth pieces are sewed up together to form a sack for covering the same. At this moment, a cloth margin is formed in the rear face side of the sack. As this cloth margin is accommodated into the concave groove formed by the step grooves, the surface of the cover cloth is free from irregular wrinkles, resulting in presentable appearance. Further, as the concave groves for accommodating the cloth margin are formed, with the respective base boards remaining flat, no three-dimensional control for running along the respective curves of the boards, is necessary, thus leading to an enhanced production processablity.

BRIEF DESCRIPTION OF THE DRAWINGS

Other objects, features and advantages of the invention will become apparent to those skilled in the art, from the following description of the preferred embodiments of the invention, wherein reference is made to the accompanying drawings, in which.

DESCRIPTION OF THE PREFERRED EMBODIMENTS

Figure 1:
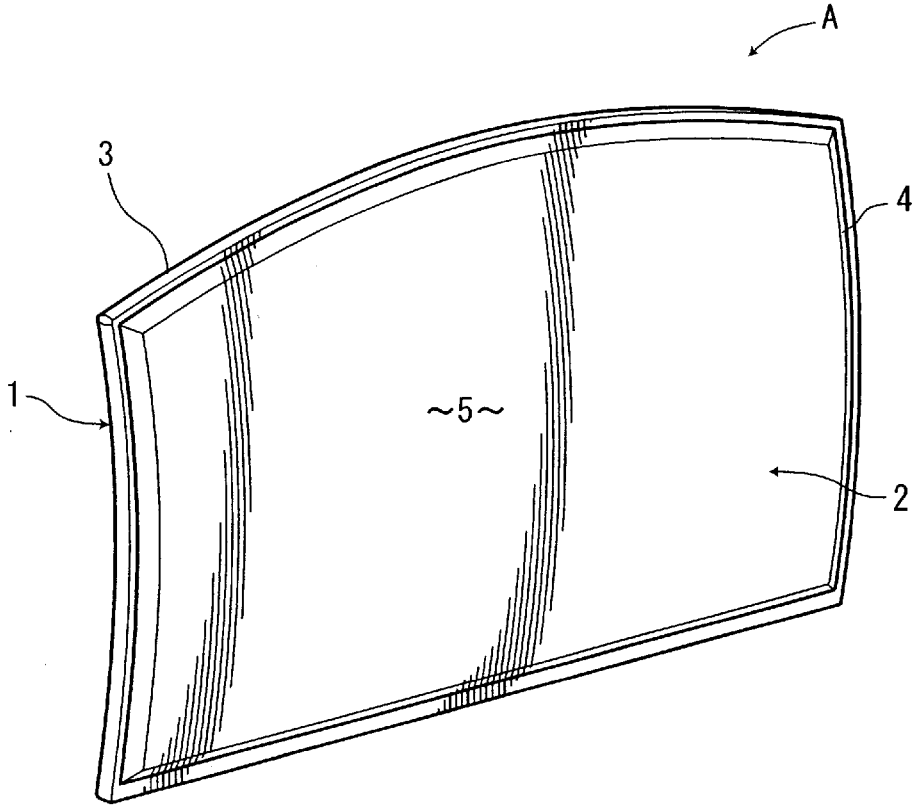
FIG. 1 is a perspective view showing a headboard manufactured according to a method of a first embodiment of the invention.
Figure 2:
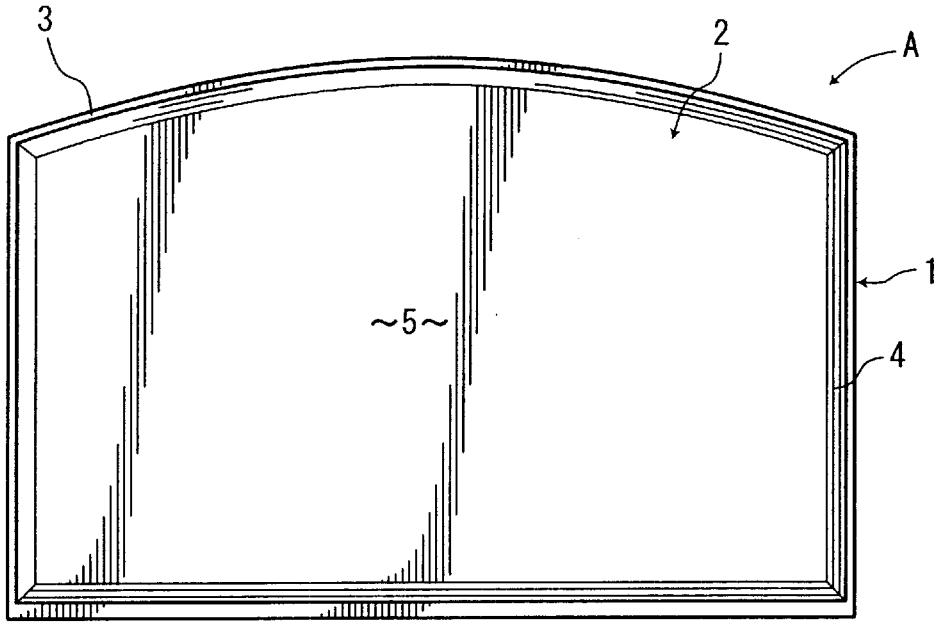
FIG. 2 is a front view of the headboard of FIG. 1.

As follows is a description of embodiments of the present invention with reference to the appended drawings. In FIGS. 1 through 5 showing a first embodiment of the invention, there is illustrated a headboard A for a bed as a decorated board of the invention. The headboard A comprises a base board 1 and a decorating material 2 which is provided integrally with the base board 1 by bonding the same to the surface of the base board 1 with adhesive. These base board 1 and the decorating material 2 are each made of woody board materials, such as plywood, particle board, and MDF (medium density fiberboard), said base board 1 and the decorating material 2 being formed by cutting such woody plate board materials, respectively. A peripheral edge of the base board 1 is formed with a chamfered portion 3, thus rounding the corners of the base board 1.

On the other hand, the peripheral edge of the decorating material 2 also is formed with a tapered chamfered portion 4 by woodworking. The decorating material 2 is formed on its surface with a paint layer 5 by applying synthetic resin paints to the surface, said synthetic resin paints being prepared by mixing pigments, colorant, wear-proof materials, dilution agent, etc. to acryl-based resin or urethane-based resin, etc. Further, the base board 1 is formed with another paint layer 6 through the top clear paint of acryl-based resin, urethane-based resin, etc.

Thus, the base board 1 and the decorating material 2 formed by cutting flat woody materials, are formed with the chamfered portions 3 and 4 by a woodworking process, which are further formed on the respective surfaces thereof with the paint layers 5 and 6 to be finished. Thereafter, they are laminated to each other by adhesive material.

Figure 3:
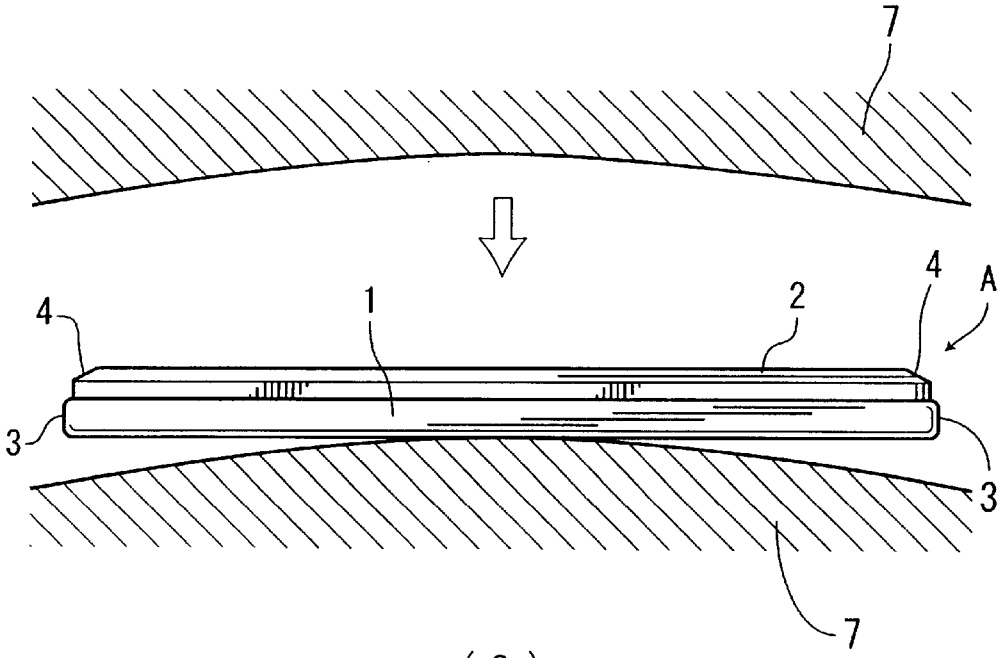
FIG. 3 is a section of the headboard which is being subjected to a bending process, in which FIG. 3(*a*) shows the headboard prior to the bending process, while FIG. 3 (*b*) shows the headboard after the bending process.
Figure 3:
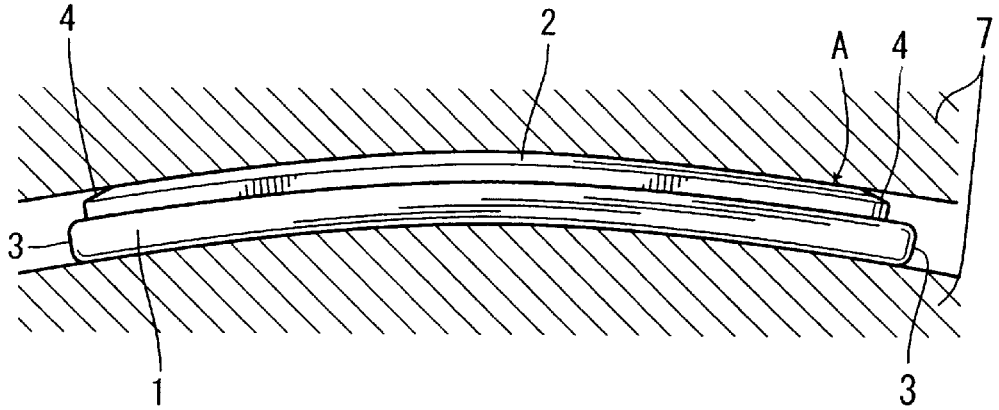
Figure 4:
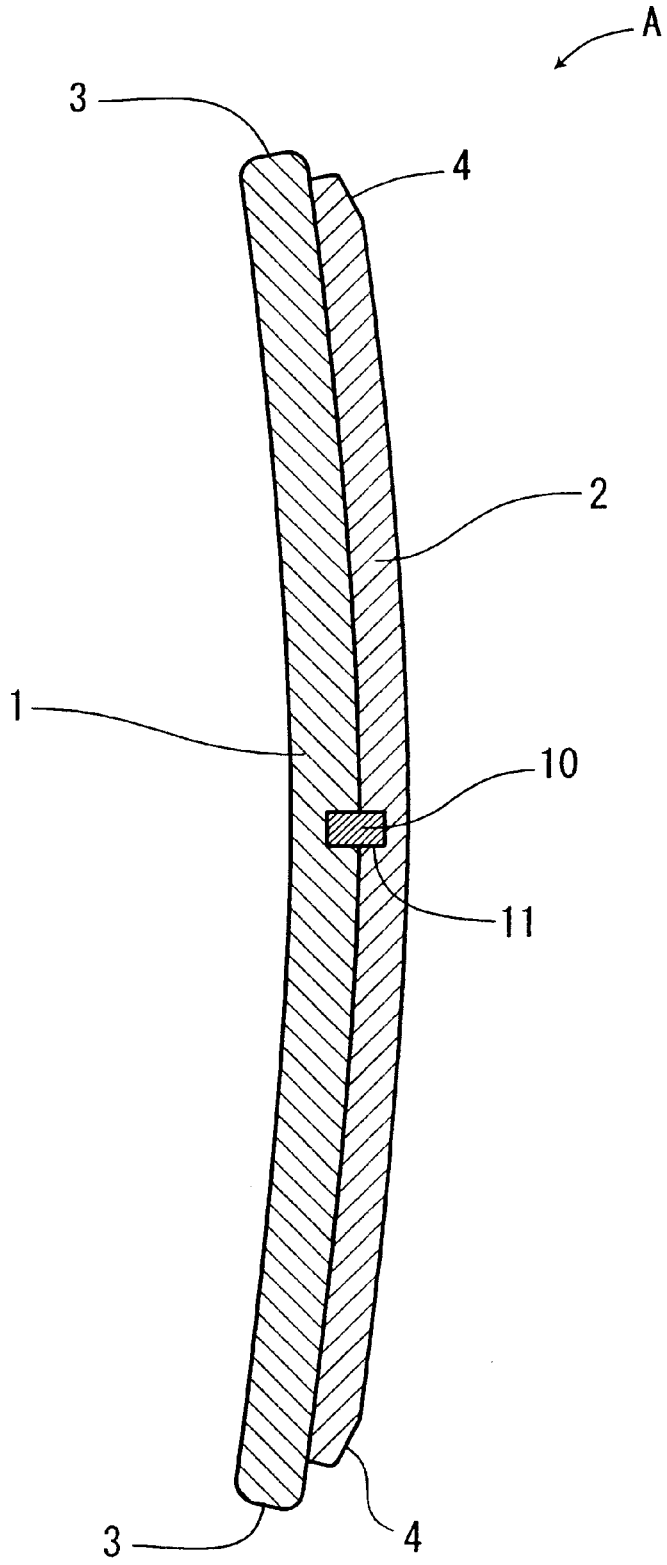
FIG. 4 is a section of the headboard of the first embodiment of the invention.
Figure 5:
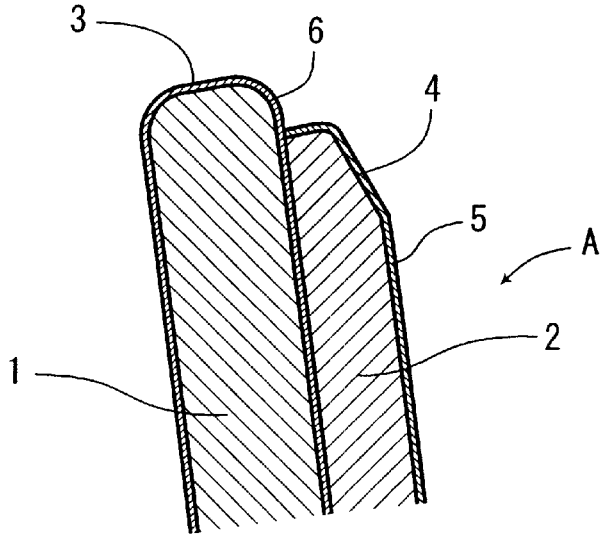
FIG. 5 is an enlarged section of a peripheral edge of the headboard of the first embodiment of the invention.
Figure 6:
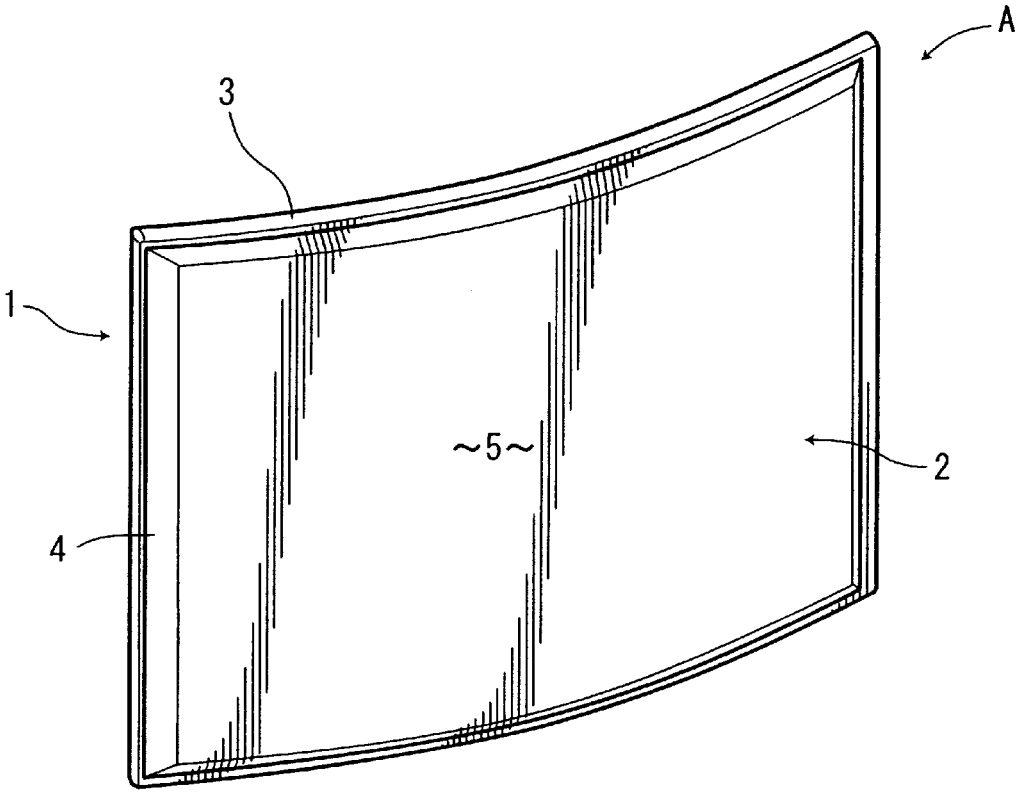
FIG. 6 is a perspective view of the headboard which is bent in lateral directions according to the first embodiment of the invention.

In the meantime, the base board 1 is provided with a plurality of engagement protrusions 10 while the decorating material 2 are provided with engagement recesses 11, so that they may engage with each other to thereby keep them in proper position when laminated to each other The base board 1 and the decorating material 2 thus laminated are clamped by a pair of dies 7 such as a pressing machine, thus forming a headboard A curved in the vertical direction. Although the base board 1 and the decorating material 2 are cut to the same size, the outer peripheral edge of the decorating material 2 laminated to the surface of the base board 1 is located inside that of the base board after they are mutually laminated and subjected to the bending process, as shown in FIG. 3(*b*).

As is apparent from the foregoing, the base board 1 and the decorating material 2 are formed through the cutting process of woody board materials. Thereafter, the edges of the base board 1 and the decorating material 2 are worked, thus forming the chamfered portions 3 and 4 in the peripheral edges of the base board 1 and the decorating material 2, respectively. Then, the painting of each surface of the base board 1 and the decorating material 2 is carried out.

As the woodworking and painting of these base board 1 and decorating material 2 are performed with the base board 1 and the decorating material 2 remaining flat, it is possible for a machining device for forming the chamfered portions 3 and 4 to be simply moved along the edges of the base board 1 and the decorating material 2. Further, even and uniform paint layers 5 and 6 can be formed on the decorating material 2 by applying painting thereto in parallel with the base board 1 and the decorating material 2, like a manufacturing process for a flat headboard.

After working and painting the base board 1 and the decorating material 2 in this way, the base board 1 and the decorating material 2 are laminated together, using an adhesive material, and thus united. Thereafter, the headboard A thus constructed by the laminated base board 1 and the decorating material 2 is clamped by the dies 7 to thereby carry out bending process. This way, there can be obtained a curved headboard A with the edges of the base board 1 and decorating material 2 which construct the headboard A being formed with the chamfered portions 3 and 4, while the decorating material 2 being decoratively painted.

Accordingly, whilst conventional techniques for working or painting such curved headboards would require three-dimensional control to run along the curved lines or faces, the embodiment of the invention allows the woodworking and painting of the base board 1 and the decorating material 2 to be performed prior to the bending process, with the board 1 and the material 2 remaining flat, whereby the automation therefor does not require an expensive five-axis controller, but a general NC router or the like will suffice, thereby leading to drastically reduced production costs as well as excellent production processability.

Further, as it is possible to form each edge of the base board 1 and the decorating material 2 into an optional shape by woodworking processing, the degree of freedom in designing a headboard A is improved. Furthermore, the automation for forming the paint layers 5 and 6 on the base board 1 and the decorating material 2 does not require any complexly controlled operation such as spraying along the curved surface of the headboard A, because the spraying of the painting can be carried out with the base board 1 and the decorating material 2 remaining flat or unbent, whereby the painting can be applied simply and uniformly. Additionally, as the base board 1 and the decorating material 2 are laminated each other after they are painted individually, no masking is necessary when they are painted in different colors, thus providing the headboard A with colorful design owing to the base board 1 and the decorating material 2 being two-toned thus way.

In addition, as the base board 1 and the decorating material 2 allow the engagement protrusion 10 of the base board 1 to engage with the engagement recess 11 formed in the decorating material 2, they are properly positioned with respect to each other, so that the base board 1 is prevented from being displaced from the decorating material 2 when the laminated base board 1 and the decorating material 2 are subjected to the bending process.

Figure 7:
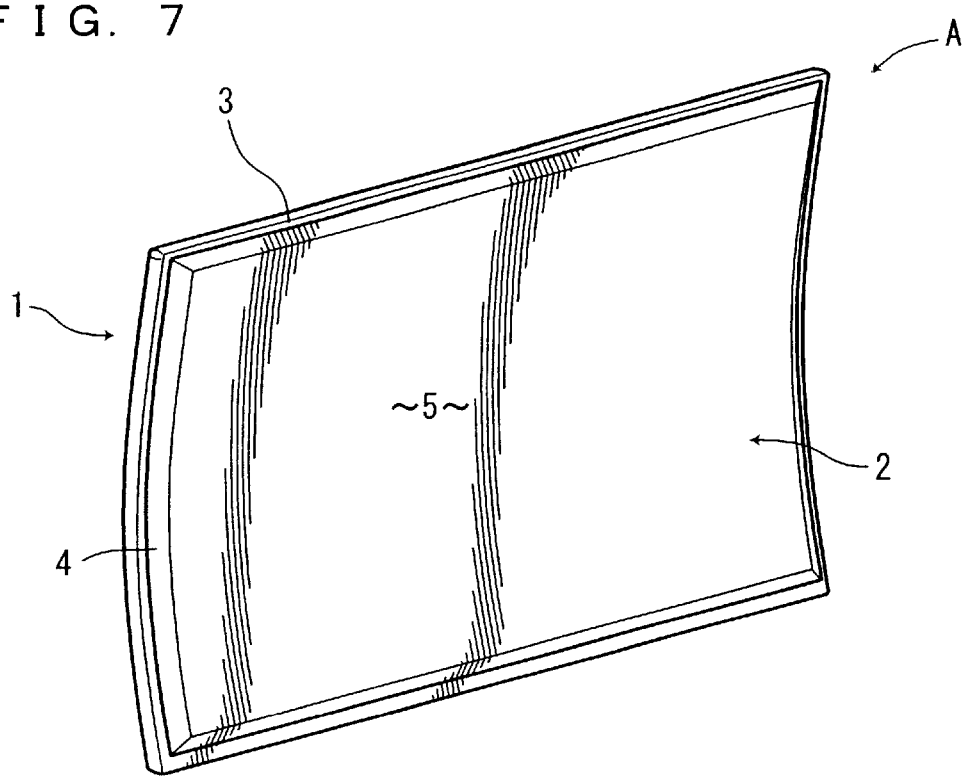
FIG. 7 is a perspective view of the headboard which is concavely bent according to the first embodiment of the invention.
Figure 8:
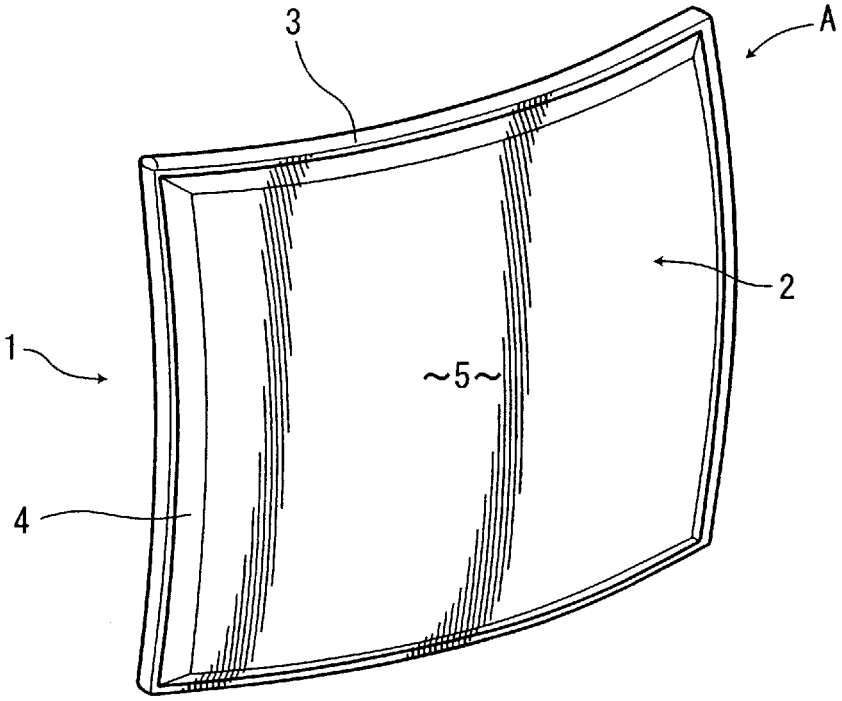
FIG. 8 is a perspective view of the headboard which is spherically bent according to the first embodiment of the invention.
Figure 9:
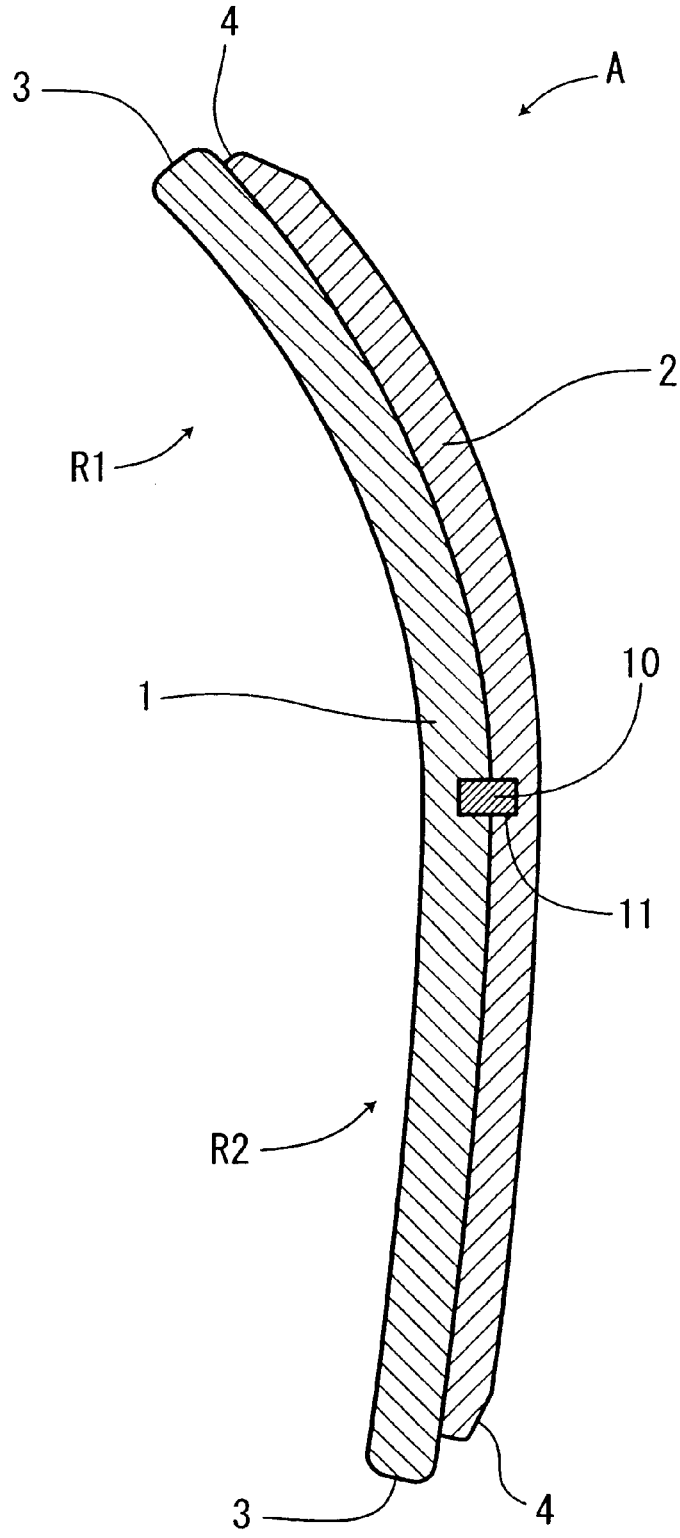
FIG. 9 is a section of a modified headboard with varied curvatures in accordance with the first embodiment of the invention.
Figure 10:
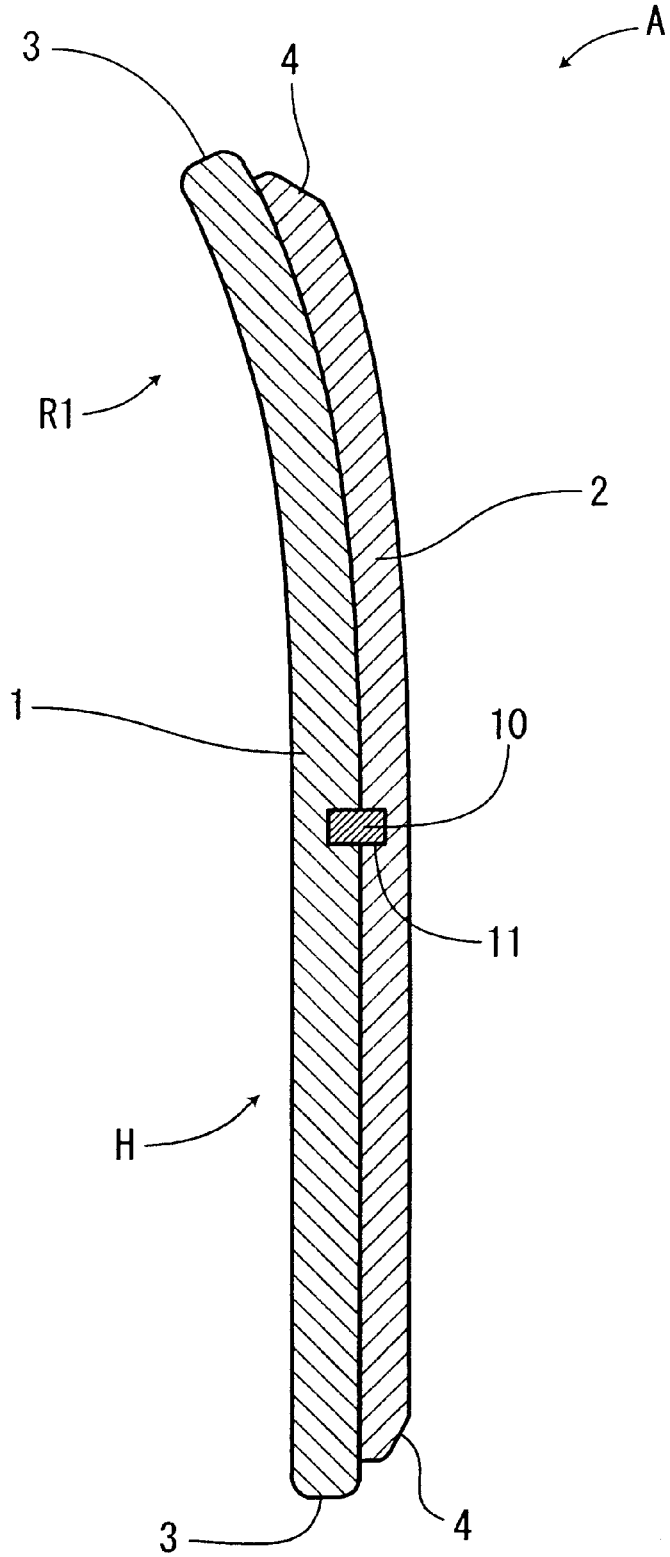
FIG. 10 is a section of a headboard which is modified so as to be formed with a straight portion and a curved portion according to the first embodiment of the invention.
Figure 11:
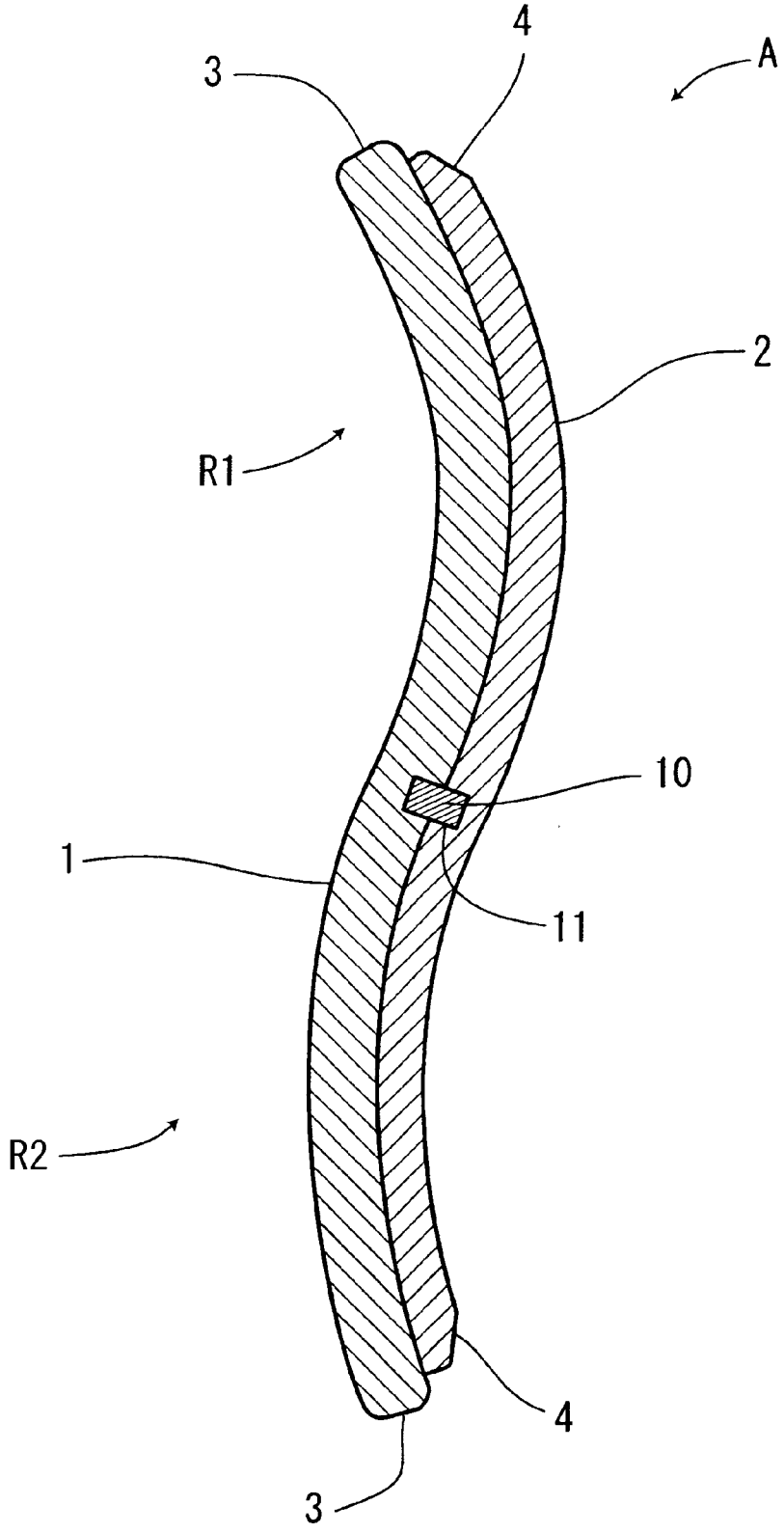
FIG. 11 is a section of the headboard which is bent into a letter "S" configuration according to the first embodiment of the invention.

Although the headboard A is bent convexly in the vertical direction in the foregoing first embodiment, it may be bent in the lateral direction. Alternatively, it may be bent concavely as illustrated in FIG. 7, or spherically as illustrated in FIG. 8. Furthermore, the headboard A may be bent in such a manner that has two or more points of inflection whilst that of the foregoing embodiment has a single point of inflection with a constant curvature. In other words, any suitable combination of surfaces may be employed such as the combination of a curved surface R1 and another curved surface R2 as shown in FIG. 9, that of a flat surface H and a curved surface R as shown in FIG. 10, and that of a concavely curved surface R3 and a convexly curved surface R4 as shown in FIG. 11.

Figure 12:
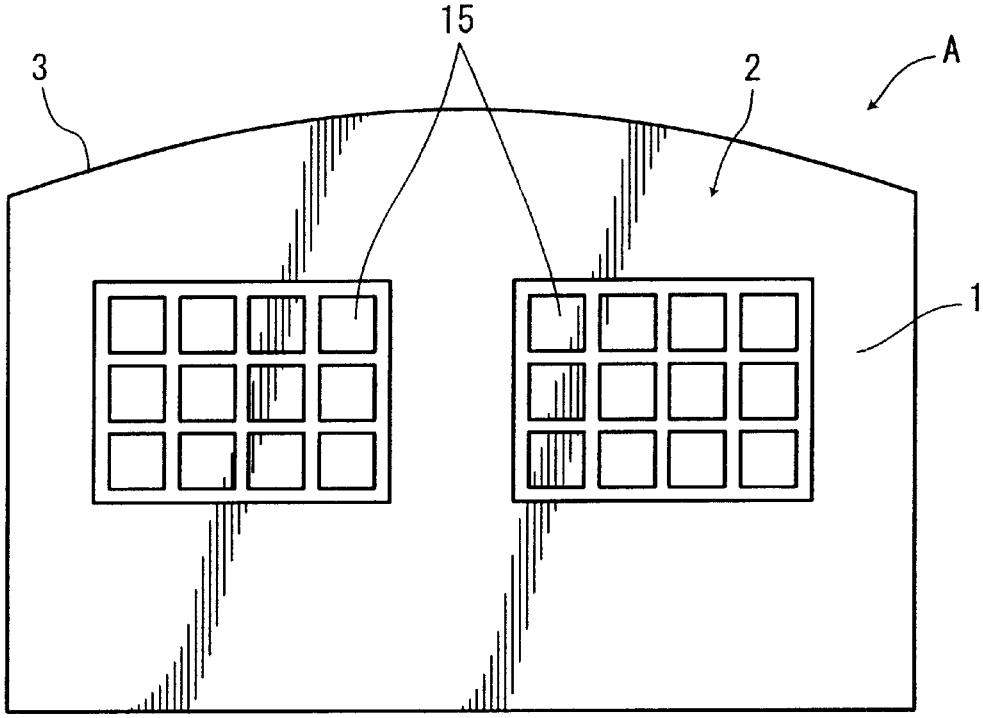
FIG. 12 is a front view of a headboard according to a second embodiment of the invention.
Figure 13:
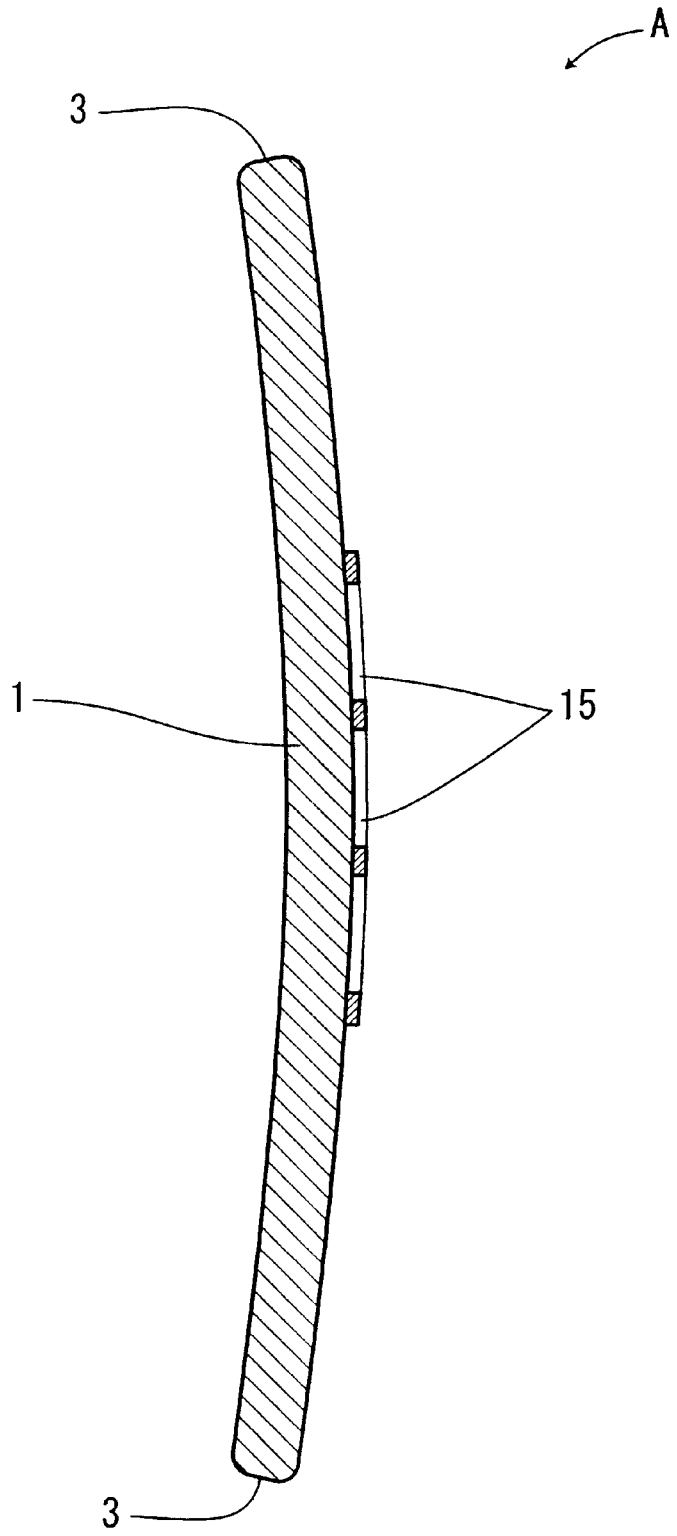
FIG. 13 is a section of the headboard according to the second embodiment of the invention.

In FIGS. 12 and 13 showing a second embodiment of the invention, the same portions as those described in the first embodiment will be designated by the same reference numerals, and their repeated detailed description will be omitted.

Whilst in the first embodiment is shown the headboard A made of the woody base board 1 and the woody decorating material 2, the second embodiment proposes another construction of the headboard A in which a grid-shaped punching metal 15 as the decorating material is laminated onto the surface of the woody base board. Thus, there can be provided a headboard A with a composite structure which is constructed of different kinds of materials, by sticking the metallic punching metal 15 to the woody base board 1, thus forming the headboard A of a novel design. Moreover, in the second embodiment, the curved chamfered portion 3 is, like in the first embodiment, formed at the peripheral edge of the base board 1 by woodworking, with the base board 1 remaining unbent, and then the base board 1 and the punching metal 15 are painted to a final product, Thus, the punching metal 15 is integrally laminated to the woodworked base board 1, which are bent by a pressing machine or the like to obtain the curved headboard A. Accordingly, like the first embodiment, it is possible to woodwork the base board 1, using a common NC router or the like, so that the cost of manufacturing the headboard A that is designed to have a curved surface can be reduced drastically. Consequently, the headboard A of a novel design in which various materials of different kinds are combined can be manufactured very easily.

Figure 14:
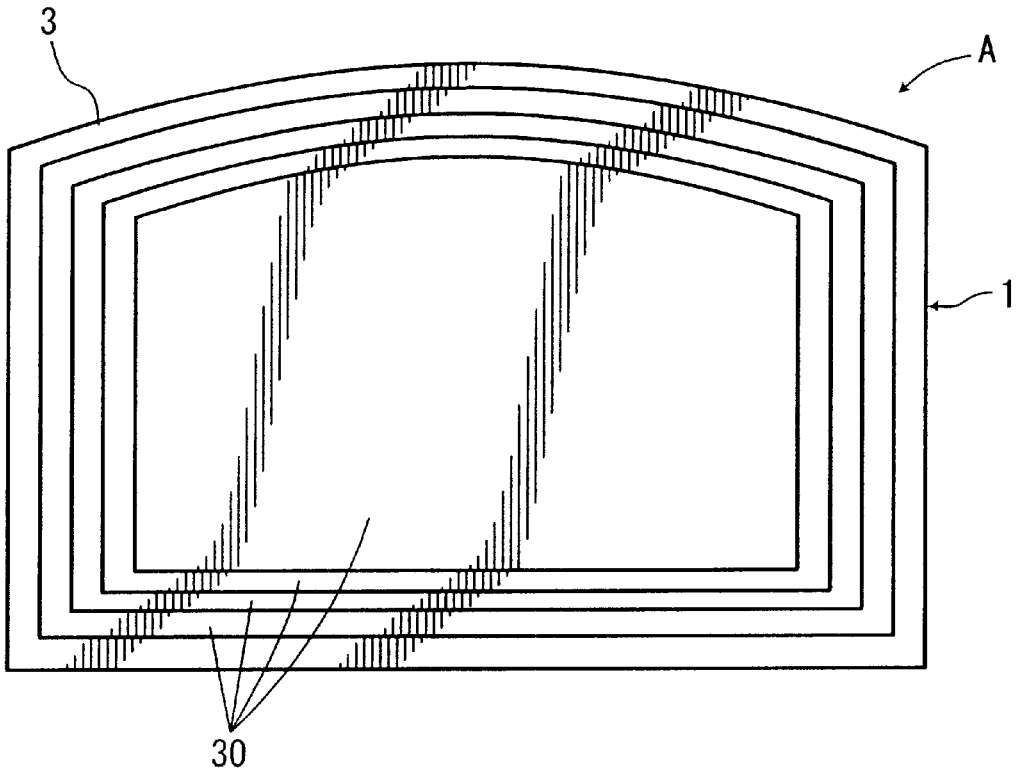
FIG. 14 is a front view showing a headboard according to a third embodiment of the invention.
Figure 15:
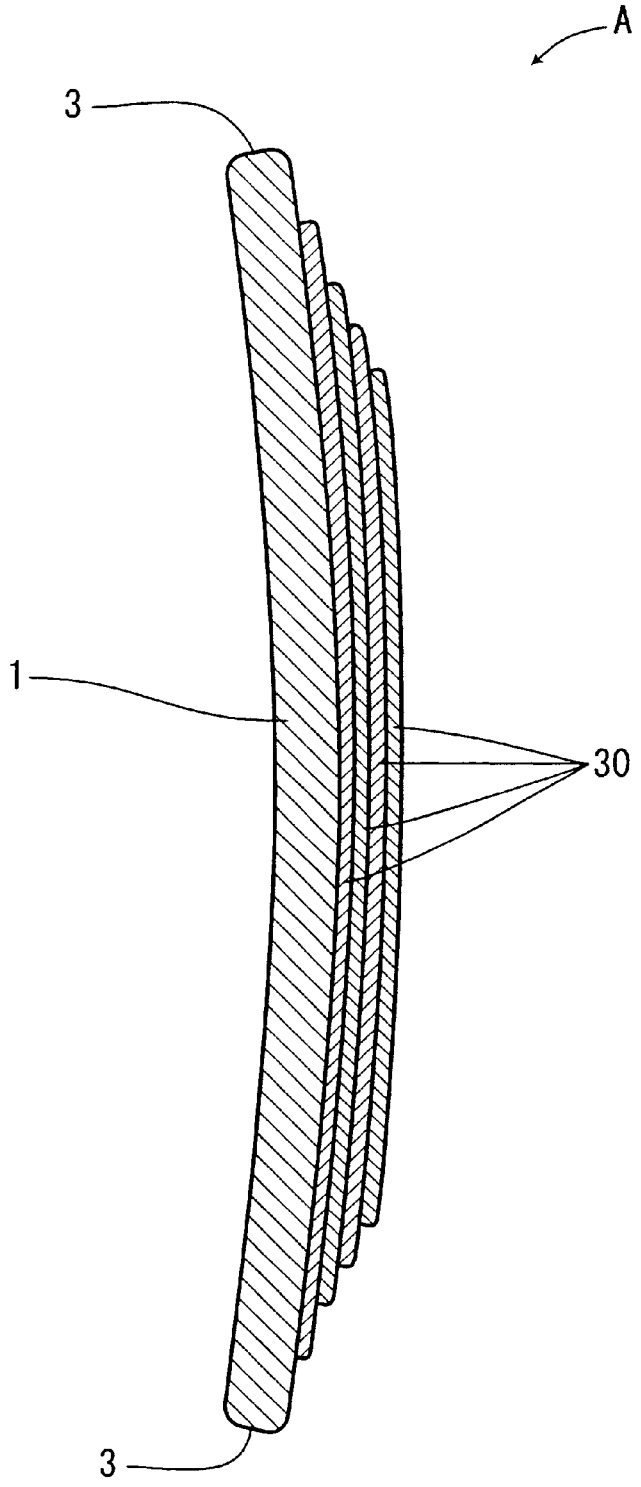
FIG. 15 is a section of the headboard according to the third embodiment of the invention.

In FIGS. 14 and 15 showing a third embodiment of the invention, any portion whose function is the same as the corresponding one described in the foregoing embodiments will be designated by the same reference numerals, and their repeated detailed descriptions will be omitted.

Unlike in the foregoing embodiments in which two members (i.e., the base board 1 and the decorating material 2) are laminated together, in the third embodiment is provided a headboard A constructed by laminating a plurality of thin decorating materials 30 to the base board 1. By laminating such multi-layered decorating materials 30 to the base board 1, it is possible to manufacture the headboard A with an excellent plastic impression and the curved surface.

It should be noted that the foregoing embodiments are not limiting, but various modifications are possible within a scope of the invention. For example, the invention is applicable to any suitable furniture product other than the above-mentioned decorated headboards, such as a backrest and an armrest of a sofa or a chair, a front board of a chest and a table board. The invention is also applicable to the manufacture of housing components such as door panels and partition plates between rooms. Further, the configuration of the base board 1 or the decorating material 2 may be suitably chosen, depending on where it is used. If the base board 1 or the decorating material 2 is to be formed circular, the respective entire peripheries thereof may be woodworked to form the chamfered portions 3 and 4. Also, the configuration of the chamfered portions 3 and 4 should not be limited, either. For example, any arbitrary edge of the base board 1 and the decorating material 2 may formed with such chamfered portion.

Figure 16:
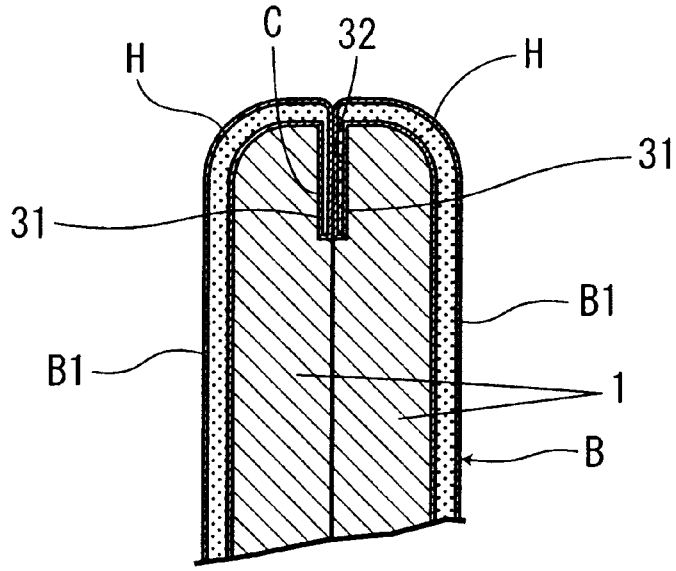
FIG. 16 is an enlarged section of a principal portion of a headboard according to a fourth embodiment of the invention.

Whilst the woody base board 1 and the punching metal 15 are proposed as one of suitable combinations of different materials in the second embodiment, the woody base board 1 may be covered with leather or cloth. In the case that the base board is covered with cloth, two base boards 1 are stuck to each other to form the headboard A, which is then covered with cloth B, as illustrated in FIG. 16 showing a fourth embodiment of the invention. The cloth B is sack-shaped by sewing two cloth pieces B1 together, including a thin cushion material H thereinside. When covering the headboard A with the two cloths that are thus sewed together, a margin C to sew up is formed in the rear face side of the sack-like cloth B. Accordingly, when the headboard A is covered with the cloth B, some portion corresponding to the margin C is likely to come off and wrinkle, resulting in unsightly appearance. To solve this problem, an inner edge of each base board 1 that constructs the headboard A is formed with a step groove 31 so that when the two base boards 1 are laminated to each other, respective peripheral edge of a laminating surface of each base board 1 may be formed with a concave groove 32 for accommodating the said margin C of the cloth B.

Figure 17:
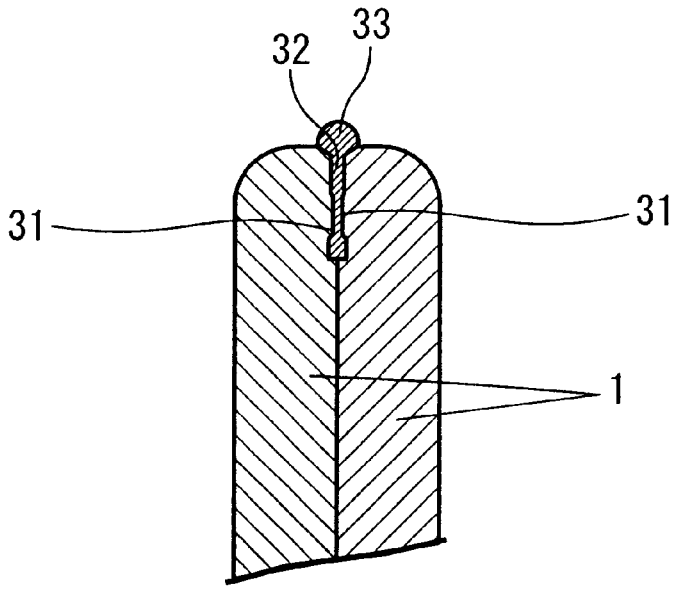
FIG. 17 is another enlarged section of a modified headboard according to the fourth embodiment of the invention, in which a decorating element is attached to a groove of the headboard.

It should be noted herein that each step groove 31 is formed, together with the chamfering portion 3 by woodworking process, with each base board 1 remaining unbent, like in the foregoing embodiments. Accordingly, the step groove 31 and the chamfering portion 3 can be worked using a general NC router or the like, so that the manufacturing costs of the headboard A can be drastically reduced, and production processability can be improved. Then, the headboard A constructed by integrally laminating the two base boards together with each base board 1 being formed with the step groove 31 and the chamfering portion 3, is bent by a pressing machine or the like so as to define a curved surface. Thereafter, the headboard A is covered with the sack-like cloth B. At that moment, the margin C formed at the rear side of the cloth B is accommodated into the concave groove 32 formed by the aforesaid step groove 31 of each base board 1, whereby the margin C is well accommodated to make the surface free from irregular wrinkles, resulting in presentable appearance. Incidentally, the step groove 31 (or the concave groove 32) formed in each base board 1 through woodworking process is not only able to accommodate the sewing margin C when the headboard A is covered with cloth, but is also able to accommodate a decorating material 33 thereinto, said decorating material 33 being made of aluminum of the like, fringing the outer periphery of the headboard A, as illustrated in FIG. 17.

Figure 18:
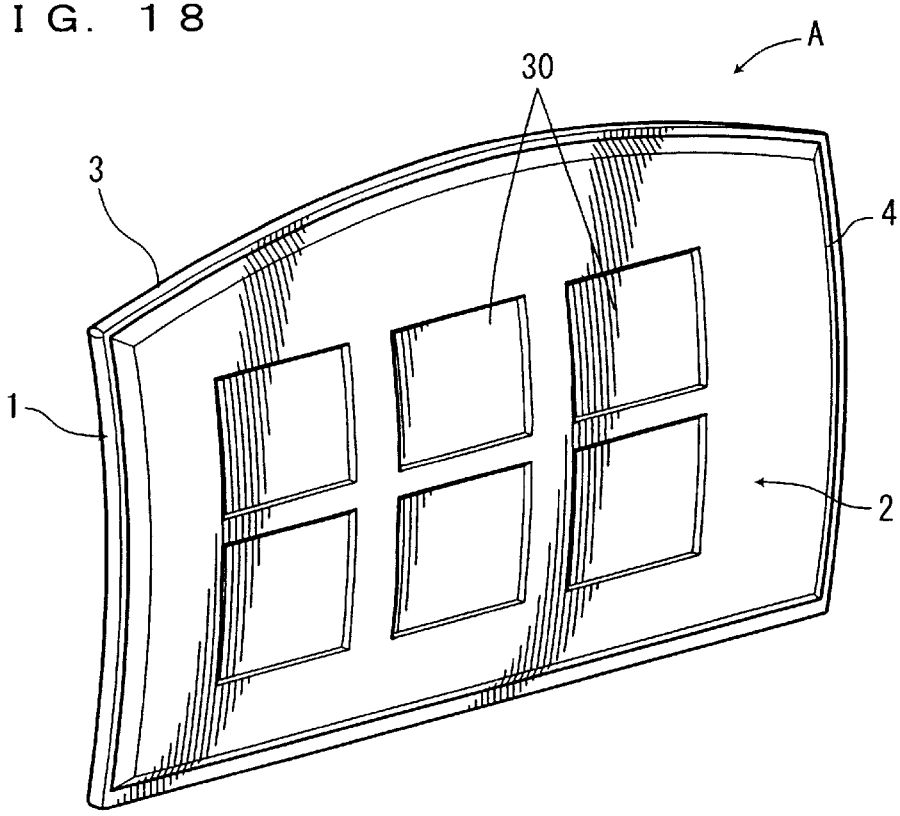
FIG. 18 is a perspective view showing a headboard according to a fifth embodiment of the invention.
Figure 19:
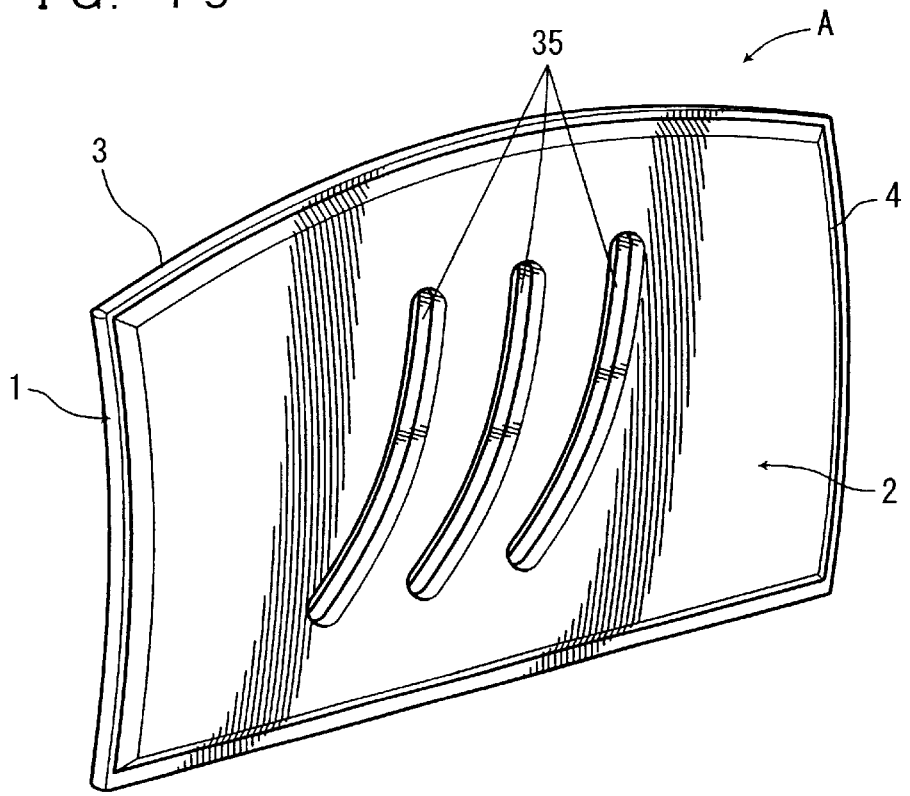
FIG. 19 is a perspective view showing a headboard according to a sixth embodiment of the invention.

Alternatively, the base board or decorating material may be processed in a different manner such that the surface of the decorating material 1 is formed with uneven decorating elements 30, as illustrated in FIG. 18 showing a fifth embodiment of the invention. Further, the base board 1 and the decorating material 2 may be formed with inclined slots 35 which are arranged in parallel, as illustrated in FIG. 19 showing a sixth embodiment of the invention.

As is apparent from the foregoing, when forming such uneven decorating elements 30 or slots 35 on the surface of the decorating material 2, they are formed with the base board 1 and the decorating material 2 remaining flat or unbent, whereby it becomes extremely easy to process such elements 30 and slots 35. After laminating the base board 1 to the decorating material 2 with the decorating elements 30 and the slots 35 thus formed, the base board 1 integrally laminated to the decorating material 2 is subjected to bending process, thus enabling the easy manufacture of the headboard A which is formed with decorating elements.

In the meantime, when the slots 35 are formed in the base board 1 and the decorating material 2, they may be painted in different colors so that the color of the base board located at the rear side of the decorating material 2 is made visible from the slots 35, thereby providing a good color contrast, enhancing design property. Alternatively, the base board 1 and the decorating material 2 may be joined together by other means than the adhesive in the foregoing embodiments, such as screws.

Figure 20:
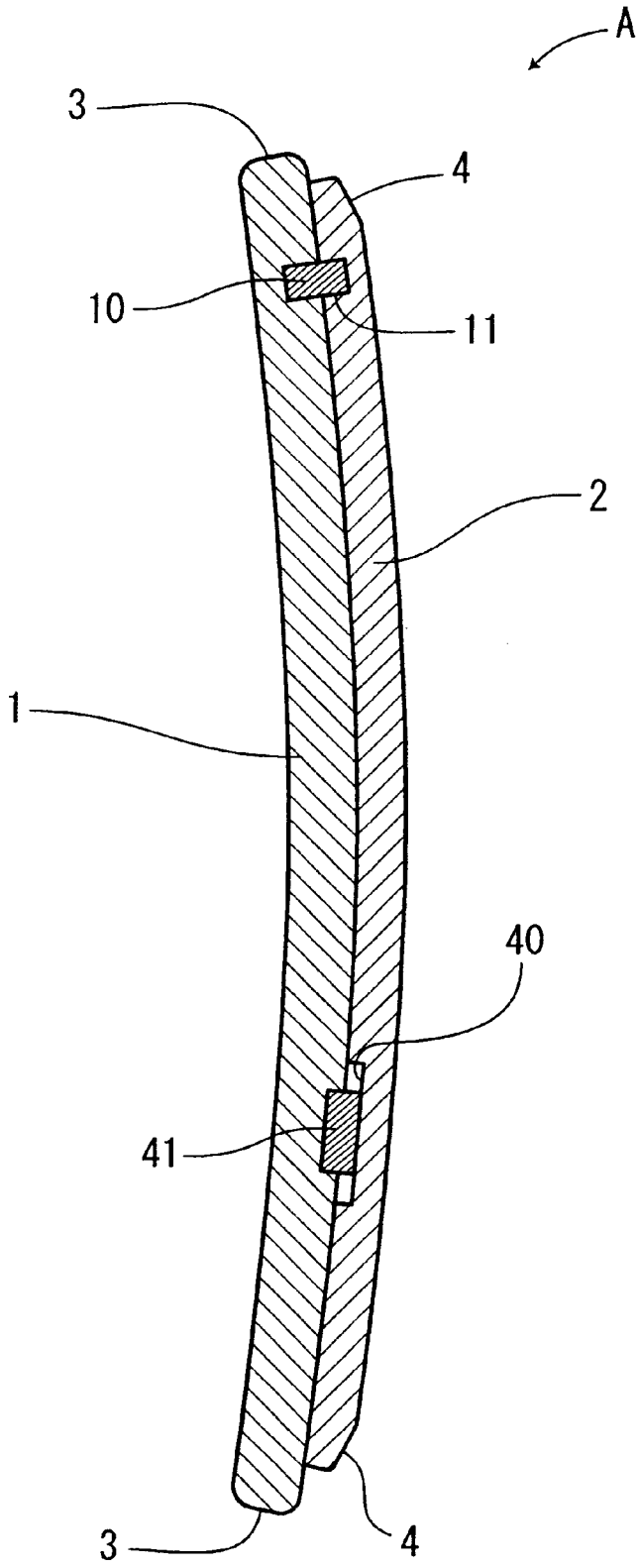
FIG. 20 is a section of a modified example of a positioning means for a headboard according to the invention.
Figure 21:
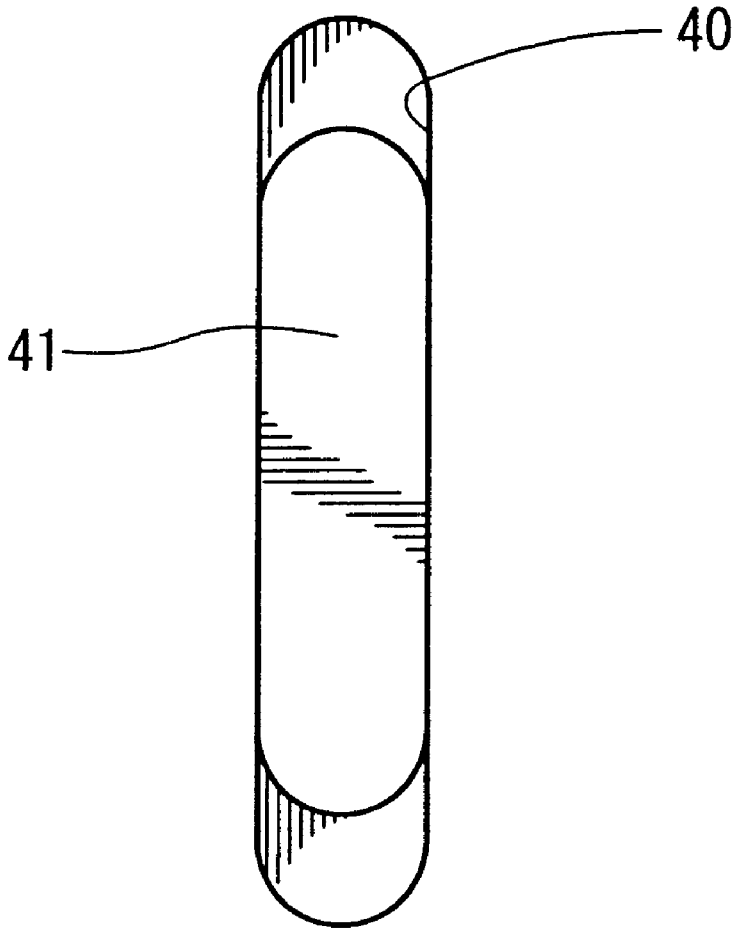
FIG. 21 is an enlarged front view illustrating a state in which a protrusion engages with a longitudinal groove according to the invention.

Whilst the base board 1 and the decorating material 2 are mutually positioned by providing the columnar engagement protrusions 10 in the base board 1 and the engagement recesses 11 in the decorating material 2, and then fitting the former into the latter in the foregoing embodiment, it is noted that when forming the headboard A to define a curved surface by laminating the base board 1 to the decorating material 2, the difference in radius of curvature between the base board 1 that is located inside and the decorating material 2 that is located outside is getting larger, as the thickness of the headboard A increases, and thus a misalignment or total displacement is likely to occur between them. FIGS. 20 and 21 illustrate a means for preventing such misalignment that is likely to occur when forming a curved surface, wherein the base board 1 and the decorating material 2 are mutually positioned at one end thereof by the engagement between the aforesaid concave and convex portions 7, 8 like in the foregoing embodiments, while they are positioned at the other side thereof by longitudinal grooves 40 formed in the decorating material 2 and protrusions 41 fixed to the base board 1, said protrusions 41 being allowed to slide along the grooves 40. By properly positioning the other side of the base board 1 and the decorating material 2, using the longitudinal grooves 40 and the protrusions 41 that slide along the grooves 40, it is possible to absorb the aforesaid possible misalignment caused when the base board 1 and the decorating material 2 are bent, using a press machine or the like, as the protrusions 41 slide along the longitudinal grooves 40.

Incidentally, the present invention should not be limited to the foregoing embodiment, but may be modified within a scope of the invention. For example, the method of the invention is not only applicable to the foregoing headboards, but may apply to other various furniture products, such as backrests or armrests for sofa or chair, front plates for chest, and tables. Further, the invention should not be limited to furniture products, but may apply to various architectural products, such as door panels, room partition plates, etc.

What is claimed is:

1. A method for forming a curved surface in a decorated board formed by laminating a flat decorating material to a flat woody base board; which comprises the steps of:

woodworking at least one of the said base board and the decorating material;

laminating said decorating material to said base board to integrally form a decorated board; and subjecting said decorated board to a bending process to define a curved surface, wherein chamfering portions are formed in said base board and the decorating material through said woodworking step, which undergoes a step of forming a coating lever on respective surfaces prior to said step of integral lamination.

2. A method for forming a curved surface in a decorated board according to claim 1; wherein the decorating material is laminated to said base board, using an adhesive.

3. A method for forming a curved surface in a decorated board according to claim 1, wherein a positioning means for positioning said base board and said decorating material is provided when they are laminated to each other.

4. A method for forming a curved surface in a decorated board according to claim 1, wherein said decorating material is made of a different material from that of said base board.

5. A method for forming a curved surface in a decorated board according to claim 3, wherein said positioning means comprises engagement concave portions and convex portions which are provided on respective joining surfaces of said base board and decorating material, said convex portions fitting in said concave portions, respectively.

6. A method for forming a curved surface in a decorated board according to claim 5, wherein said concave portions are longitudinal grooves, while said convex portions are protrusions which are slidable along the longitudinal grooves.

7. A method for forming a curved surface in a decorated board according to claim 1, wherein said curved decorated board defines two or more points of inflection.

8. A method for forming a curved surface in a decorated board according to claim 1, wherein said decorated board is a headboard.

9. A method for forming a curved surface in a decorated board formed by laminating two fiat base boards, which comprises the steps of:

forming a step groove in at least an inner edge of each base board;

laminating these two base boards to each other to integrally form a decorated board;

subjecting the decorated board to a bending process;

covering the bent decorated hoard with a cloth, while accommodating a margin of the cloth into a concave groove formed by said step groove of each base board.

* * * * *

UNITED STATES PATENT AND TRADEMARK OFFICE

CERTIFICATE OF CORRECTION

PATENT NO. : 6,668,881 B2
DATED : December 30, 2003
INVENTOR(S) : Shigeru Annaka It is certified that error appears in the above-identified patent and that said Letters Patent is hereby corrected as shown below:

Column 8,
Line 36, replace “lever” with -- layer --
Line 66, replace “fiat” with -- flat --

Signed and Sealed this

Twenty-fifth Day of January, 2005

JON W. DUDAS
*Director of the United States Patent and Trademark Office*